United States Patent [19]

Cavallaro et al.

[11] Patent Number: 4,907,992

[45] Date of Patent: Mar. 13, 1990

[54] OIL DISTRIBUTION BOX FOR A MARINE CONTROLLABLE PITCH PROPELLER

[75] Inventors: Joseph L. Cavallaro, Canton, Mass.; Arthur J. Richards, Jr., Glendale, R.I.; Charles A. Busche, Hanson, Mass.

[73] Assignee: Bird-Johnson Company, Walpole, Mass.

[21] Appl. No.: 258,480

[22] Filed: Oct. 17, 1988

[51] Int. Cl.[4] ..... B63H 3/00

[52] U.S. Cl. ..... 440/50; 416/25; 416/157 R; 440/86

[58] Field of Search ..... 440/49, 50, 75, 84, 440/86; 416/25, 27, 147, 156, 157 R

[56] References Cited

U.S. PATENT DOCUMENTS

| | | | |
|---|---|---|---|
| 2,342,665 | 2/1944 | Hammond et al. | 440/50 |
| 2,931,443 | 4/1960 | Pehrsson | 440/50 |
| 3,302,724 | 2/1967 | Brooks et al. | 416/27 |
| 3,693,575 | 9/1972 | Mades | 440/50 |
| 3,788,768 | 1/1974 | Prampart | 416/157 R |
| 3,895,598 | 7/1975 | Blickle | 440/50 |
| 4,142,829 | 3/1979 | Inoue et al. | 416/25 |
| 4,533,295 | 8/1985 | Duchesneau | 416/27 |
| 4,639,192 | 1/1987 | Harrell | 416/27 |
| 4,648,797 | 3/1987 | Martin | 416/27 |

OTHER PUBLICATIONS

Bird-Johnson Company Brochure, "Controllable Pitch Propeller".

*Primary Examiner*—Sherman D. Basinger
*Assistant Examiner*—Stephen P. Avila
*Attorney, Agent, or Firm*—Brumbaugh, Graves, Donohue & Raymond

[57] ABSTRACT

An oil distribution box for a marine controllable pitch propeller of the type having a main hydraulic servo within a hub for controlling the pitch of propeller blades rotatably carried by the hub and including a directional valve actuated by a tubular valve rod extending through the propeller shaft from the oil distribution box comprises an outer stationary housing, a shaft received within the housing and coupled to the propeller shaft and an auxiliary servo chamber cylinder coupled to the shaft. A piston received in the servo chamber is coupled to the valve rod. Oil is supplied to the valve rod through an elongated annular supply chamber defined between the shaft and the valve rod by spaced-apart seals, a port in the valve rod opening to the supply chamber, a port in the shaft opening to the supply chamber and a journal clearance seal between the housing and shaft in register with the port in the shaft. Oil is supplied to the servo chamber selectively to the chamber sections on the respective opposite sides of the piston through, for each section of the servo chamber, a supply-return passageway in the cylinder communicating with the servo chamber, a passage in the housing, and a journal clearance seal between the housing and the servo chamber cylinder in register with the passage and the passageway. A normally closed pilot-operated check valve in each passageway isolates the servo chamber from the clearance seals except when oil is supplied to the auxiliary servo to produce a pitch change.

7 Claims, 6 Drawing Sheets

O.D. BOX HYDRAULIC SCHEMATIC

OIL DISTRIBUTION BOX FOR A MARINE CONTROLLABLE PITCH PROPELLER

FIELD OF THE INVENTION

The present invention relates to an oil distribution box for a marine controllable pitch propeller of the type in which a hydraulic servo in the propeller hub controls the pitch position of the propeller blades.

BACKGROUND OF THE INVENTION

Controllable pitch propellers ("CPP") have many advantages over fixed pitch propellers, particularly in vessels that are operated at a variety of speeds and/or loads or that require superior maneuverability. In many commercial applications the increased maneuverability and economical operation can far outweigh the higher initial cost of a CPP. CPPs are widely used in military vessels because of their superior responses to control commands such as speed changes. In some navy ships a quick reversal of the CPP from full speed ahead to full speed astern can stop the ship in less than four ship lengths.

Bird-Johnson Company ("BJCo"), the assignee of the present invention, has for many years manufactured CPP systems of the type having a hub and blade assembly, a main pitch-control hydraulic servo in the hub, an oil distribution box that operates the pitch-control servo, and a control system that controls the oil distribution box. Although the present invention relates to an improved oil distribution box, it is necessary to have a general understanding of the hub and blade assembly, i.e., the CPP.

The BJCo CPP comprises a hub having a plurality of blade-mounting ports, each of which receives a crank ring to which the blade is attached (either integrally or by bolts) and by which the blade is pivoted about an axis substantially perpendicular to the shaft axis to change its pitch setting. Within the hub is a hydraulic servo that consists of a cylinder, a piston reciprocably movable within the cylinder chamber, a piston rod, and a directional valve for controlling the supply and return of hydraulic fluid to and from the cylinder chamber. Each crank ring carries an eccentric crank pin, and the piston rod is affixed to a crosshead that has a slideway slot corresponding to each crank pin. Each slot receives a sliding block having a hole for the crank pin. When the piston rod moves axially, the crosshead moves with it and moves the sliding blocks along arcs centered on the pivot axes of the blades, thereby exerting forces on the crank pins that rotate the crank rings and blades in the mounting ports and changing the pitch setting of the blades. The hub and blade assembly can be controlled to maintain any desired propeller pitch between a maximum ahead pitch and a maximum astern pitch.

As its name implies, the oil distribution ("OD") box of the CPP system distributes oil (the preferred hydraulic fluid) from a pressurized source to the main servo in the hub. To carry out its ultimate function, the OD box is called upon to do several things. First, it provides a rotary coupling or joint between a stationary oil source and feed and return passages through the ship's shafting. Second, it controls the main directional valve of the main servo. Third, it has a built-in emergency pitch positioner that mechanically sets and holds a desired propeller pitch for emergency "take-home" operation.

In the BJCo CPP system the OD box is usually, though not always, mounted on the forward end of the main reduction gear casing by a mounting flange at the aft end of a stationary housing. The aft portion of the OD box housing receives the forward end of a rotating valve rod that extends aftward through the hollow shaft of the output gear of the gear box and all the way aft through the propeller shaft to the directional valve in the propeller hub. The pressure oil supply line is connected to a supply port in the OD box housing. Because the valve rod moves axially within the housing to control the directional valve in the hub, an intermediate oil supply chamber is defined along a length of the valve rod somewhat longer than the stroke of the valve rod by a rotating tube that surrounds, rotates with and is sealed at opposite ends to the valve rod. Pressure oil flows from the supply port into the intermediate supply chamber through journal clearance seals between the stationary OD box housing and the rotating tube. Holes in the valve rod within the supply chamber admit the oil to the valve rod at all positions along its full operating stroke.

Oil returns from the main servo in the propeller hub through the annular passage between the inside wall of the propeller shaft and the outside wall of the valve rod. The tube that forms the intermediate chamber has passages that allow return oil to pass into an oil return section of the chamber within the OD box housing forward of the journal clearance seals. The oil return line of the CPP system hydraulics is coupled to a return port in the housing opening to the oil return section.

Fore and aft movements of the valve rod to control the directional valve in the hub are provided by an auxiliary servo in the OD box. It is useful to mention, at this point, that a further aspect of the BJCo CPP system being described here is the use of the valve rod to provide feedback information, in the form of its axial position, of the pitch setting of the propeller. To this end the directional valve for the main servo is a four-way open center directional control valve, in which the valve body is built into the piston rod and the valve spool is attached to the aft end of the valve rod. With this design the main servo piston tracks (follows) every movement of the valve rod.

Another aspect of the BJCo CPP system design is the capability of mechanical pitch-setting for emergency take-home. When the main servo is inoperative to control the propeller pitch for whatever reason, movement of the valve rod in the forward direction by the auxiliary servo in the OD box engages an abutment on the valve spool against a shoulder on the piston rod, thereby mechanically moving the main servo piston, piston rod and crosshead forwardly to set and maintain mechanically (as far as the hub and blade assembly is concerned) the desired propeller pitch for emergency take-home operation.

Movement of the piston, piston rod, and crosshead mechanically to set and maintain a desired pitch for take-home operation requires the application of a very high pressure to the auxiliary servo cylinder. Moreover, journal clearance seals are inherently controlled leakage seals, which means that maintenance of emergency take-home pitch would require continuous pumping at high pressure to compensate for leakage if the servo cylinder were rotating with the shaft and the oil were supplied through journal clearance seals. Therefore, the OD boxes of the prior designs have a non-rotating auxiliary servo that is coupled to the rotating valve rod by anti-friction thrust bearings. The OD box has a stationary cylinder section adjacent to its forward end that receives two axially spaced-apart pistons coupled to each other by a piston rod and together forming with the cylinder section a working chamber. The working chamber is divided into fore and aft parts by an annular divider wall affixed to the housing and sealed to the piston rod. The pistons, piston rod and wall are non-rotatable and are coupled by an anti-friction thrust bearing to the valve rod. The non-rotating seals of the auxiliary servomotor are fully up to the requirements for maintaining the high oil pressure required for emergency mechanical take-home pitch setting. A mechanical lock is provided at the forward end of the OD box which is engaged with the forward piston by rotating the lock clockwise to a stop. When the mechanical lock is applied, the valve rod is stretched to a pre-loaded state for the purpose of resisting alternating hydrodynamic loads. The preload is transmitted from the valve rod to the non-rotating servo through the thrust bearing, thus limiting the life of the bearing during take-home operation. The reaction of the preload on the servo housing is applied to the forward side of the reduction gear case.

In addition to providing for the establishment of an emergency take-home propeller pitch setting, solely linear motion of the auxiliary servo piston also makes it easy to deliver pitch-setting feedback information by a follow-up rod attached to the piston and extending out through a sealed opening in the forward end wall of the OD box housing.

The above-described BJCo CPP system has been proven by many years of service on dozens of naval vessels throughout the world to be extremely reliable, durable and effective. Like any mechanical device with moving parts periodic overhaul is, of course, necessary. In the case of OD box, for example, the thrust bearings between the valve rod and the auxiliary servo piston have to be replaced periodically. Moreover, as the end of their service life approaches, there is an ever-increasing fear that they might fail if called upon to endure the high loads imposed by running in the emergency take-home mode. In this regard, the load on the thrust bearing when the OD box is in the emergency take-home mode is more than five times as great as that when it is controlling the actuating valve of the main servomotor. In addition the OD boxes of the prior design described above require that the casing of the reduction gear box be designed to carry the reaction load of the valve rod when the system is in the take-home mode, inasmuch as the reaction load is transmitted through the OD box housing to the gear box casing.

SUMMARY OF THE INVENTION

An object of the present invention is to provide an improved OD box for a CPP system of the type having a hub and blade assembly that includes a main servo in the hub for controlling the blade pitch. One important object is to eliminate the reaction-loading of the gear box case in the emergency take-home mode of operation, thereby substantially reducing the design strength requirements for the gear box case. A further and more particular object is to provide an OD box that has no thrust bearings and thus does not require overhauling as often as the previous OD box. Still another object is to simplify the construction of the OD box by reducing the number and complexity of the components.

The foregoing as well as other objects are met, according to the present invention, by an OD box comprising an outer stationary housing, a shaft received within the housing and adapted to be coupled to the propeller shaft for rotation therewith by way of an output shaft of the gear box, and an auxiliary servo within the housing and including a cylinder coupled to the shaft and a piston received in the cylinder and coupled to the valve rod. High pressure oil is supplied from a source to the valve rod for conduction by the valve rod to the main servo of the propeller hub by way of an annular supply chamber defined between the shaft and the valve rod by spaced-apart seals, a port in the valve rod opening to the supply chamber, a port in the shaft opening to the supply chamber and a journal clearance seal between the housing and shaft in register with the port in the shaft and a port in the housing. Oil under pressure from a source is supplied to the sections of the servo chamber of the auxiliary servo selectively on the respective opposite sides of the piston by way of, for each section of the servo chamber, a supply-return passageway communicating with the servo chamber and with a passage in the housing and a journal clearance seal between the housing and servo cylinder in register with the passage and the passageway.

A normally closed pilot-operated check valve in each supply-return passageway opens in response to the supply of oil to either of the passages such that the oil is supplied to the selected section and returned from the other section, thereby to actuate the auxiliary servo and produce a change in the pitch-setting. When the control system of the CPP does not call for a pitch change by supplying oil to the auxiliary servo, the check valves isolate the servo cylinder from the journal clearance seals, thereby hydraulically locking the auxiliary servo and maintaining the selected pitch-setting. In a preferred embodiment oil may be supplied under pressure selectively to each section of the auxiliary servo chamber from an emergency source and returned to the emergency source from the other chamber section to provide a mechanical pitch-setting for emergency take-home operations of the propeller. In the emergency take-home mode the check valves isolate the chamber from the journal clearance seals and vice versa. Advantageously, he check valves are built into a cylinder head member of the auxiliary cylinder.

It is preferred that the piston of the auxiliary servo be carried by a piston rod that is coupled to the valve rod and includes a portion projecting forwardly through the cylinder head member in sealed relation, whereby its axial position provides an indication of the propeller pitch. Also, the piston rod preferably extends entirely through the cylinder chamber in all positions of its working stroke and is of uniform diameter so as to provide equal and opposite changes in displacement in the sections of the chamber on opposite sides of the piston upon movement of the piston.

As mentioned above, in the prior OD box the reaction load imposed by the auxiliary servo operated in the take-home mode is transferred by the OD box housing to the main reduction gear casing; this is because the oil in the auxiliary servo acts equally and oppositely on (1) one of the two pistons, and (2) the wall affixed to the OD box housing that divides the working chamber to make the servo double-acting. The high loading of the gear box casing is disadvantageous.

In the present invention the cylinder of the auxiliary servo is fastened directly to the propulsion shafting. Accordingly, the oil acts equally and oppositely (1) on the piston to apply a force on the valve rod to maintain the take-home pitch and (2) on the cylinder end, which is effectively part of the propeller shaft. Thus the reaction load is imposed on the propeller shaft, and not on the gear box casing.

Preferably, according to the invention, a locking device is provided for mechanically coupling the protruding forward end portion of the auxiliary servo piston rod to the head member of the auxiliary servo cylinder with the valve rod in a forward position establishing a full-ahead, mechanical take-home propeller pitch and pre-loaded in tension to resist oscillating hydrodynamic loads. In an exemplary embodiment, the protruding forward end portion of the auxiliary servo piston has a sleeve member that can be moved forward to open up a groove, and a double C-shaped collar received in the groove engages the aft edge of the sleeve member and the forward face of the auxiliary servo cylinder head member to hold the full-ahead pitch and the valve rod preload. Inasmuch as the auxiliary servo cylinder is affixed to the propeller shaft, the reaction load of the valve rod in the mechanically coupled mode is imposed on the propeller shaft.

Another advantage of the invention is the elimination of the thrust bearing used in the prior OD box, which, in turn, increases the service time of the OD box between overhaul and makes it more reliable.

The reduction in the number of parts is dramatic; by actual count the previous OD box had 140 parts, whereas the invention has only 87. The invention is interchangeable with the previous OD box, so it can be retrofitted to existing CPP systems. In this respect a preferred embodiment makes provision for a prairie air tube running from an air supply union forward of the OD box, through the OD box, and through the shafting all the way to the tail of the hub. Feedback of the propeller pitch is provided by extending the piston rod of the auxiliary servomotor forwardly though a hole in the forward cylinder end wall, preferably maintaining the piston rod at uniform diameter for its full length to avoid pressure surges in the auxiliary servomotor. Indeed, it is fortuitous that the feedback and uniform-displacement features are fulfilled in such a simple way.

For a better understanding of the invention reference may be made to the following description of an embodiment, taken in conjunction with the accompanying drawings.

DESCRIPTION OF THE EMBODIMENT

Figure 1A:
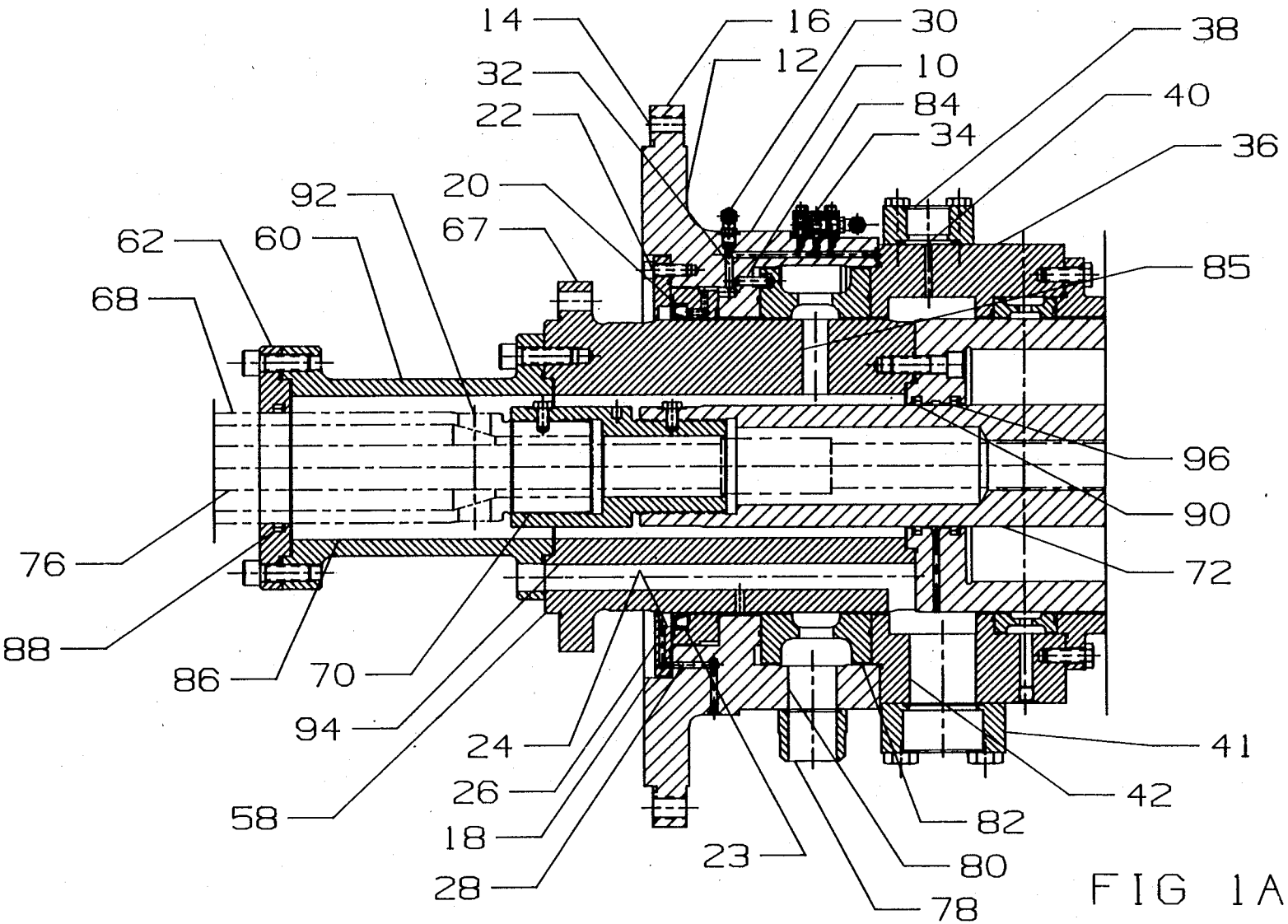
FIGS. 1A and 1B, taken together end-to-end, make up an axial cross-sectional view of the embodiment.

The housing 10 of the OD box is built up from several ring-like components dowelled and bolted together end-to-end, this construction being required to enable assembly of the three rotary seals used in the OD box. At the aft end (the left side of FIG. 1A) is a component 12 having a mounting flange portion 16. Bolt holes 14 arranged in a circular row in the flange portion 16 receive bolts (not shown) that fasten the box to the forward wall of the reduction gear casing (not shown). A recess 18 in the aft end face receives a lip seal assembly 20 fastened in place by cap screws 22. Any oil that leaks past the lip seal element 23 is picked up in a groove 24 in the seal element retainer 26 and drained off through a series of passages 28 for return to the oil reservoir of the CPP system hydraulics. The seal assembly 20 is pressurized by oil that leaks past the aft part of the journal clearance seal (82, described below) associated with the high pressure oil feed for the main servo in the propeller hub. The pressure on the seal assembly 20 is controlled by an unloading valve 34 connected through a fitting 30, a system of passages 32 and a line not shown, but see FIG. 7).

A return oil housing part 36 is dowelled and bolted to the forward end of the flange component 12. A flanged connection 38 on the top is connected to a head tank (see FIG. 7) that supplies oil at all times, including full shutdown of the CPP system, to the oil return side of the main servo in the propeller hub through a passage 40. A flange connector 41 on the bottom of the housing part 36 is connected to the reservoir of the pump (not shown) of the CPP system hydraulics at the outer port opening of a passage 42 that communicates with the oil return side of the main servo in the propeller hub, as described below.

An intermediate housing part 44 is dowelled and bolted to the forward end of the return oil housing part 36, and a forward housing part 46 is similarly fastened to the forward end of the intermediate part 44. A forward lip seal assembly 48 fitted to the forward end of the part 46 is pressurized by oil that leaks past the journal clearance seal 108 (described below). The pressure is controlled by the unloading valve 34 (described above), which is connected by a line (not shown) to a connection 50. The seal retainer ring 52 is formed with an inwardly open, annular chamber that captures any oil that leaks past the lip seal element 54 for recovery from a drain passage 56.

The housing 10 and the components associated with it are stationary. Running within the housing 10 is a rotating assembly that (1) provides a rotary joint for supply and return of oil between the main servo in the propeller hub and the CPP system hydraulics, (2) provides a rotary joint for supply and return oil for the auxiliary servo, which is mechanically connected to the valve spool of the main servo in the hub, thereby providing propeller pitch control from inboard, and (3) provides mechanical pitch-setting of the CPP for emergency take-home operation.

At the aft end of the rotating assembly of the OD box are a shaft 58, a shaft extension 60, and a seal housing 62, and at the forward end are the cylinder member 64 and the cylinder head 66 of the auxiliary hydraulic servo. The aforementioned components are dowelled and bolted to each other to form a unit that is, in turn, bolted to the forward end of the output shaft (not shown) of the reduction gear box by means of a flange portion 67 on the OD box shaft 58. The aft end of the output shaft of the gear box is coupled to the propeller shaft. The shaft and servo chamber unit of the OD box are axially stationary.

The valve rod 68 that controls the valve spool of the main servo directional valve in the propeller hub runs the full length of the propeller shaft and through the output gear shaft of the reduction gear box and extends a short distance into the shaft extension 60 where it is connected by a length-adjusting turnbuckle coupling tube 70 to the piston rod 72 of the auxiliary servo piston 74. As described in more detail below, the valve rod 68, piston rod 72 and piston 74 rotate with the propeller and propeller shafting and move axially along a stroke distance equal to that of the main servo in the propeller hub in normal operation and somewhat greater than that of the main servo and pitch control mechanism of the propeller during emergency take-home operation.

The embodiment is designed for military applications and, therefore, has a prairie air system. The prairie air tube 76 runs forward from the propeller within the valve rod, passes through the OD box within the piston rod 72, and extends forward to a rotary joint (not shown) forward of the OD box to receive air from the prairie air supply. In non-military applications the prairie air tube 76 will be omitted. The prairie air tube plays no role in the essential functions of the OD box or the CPP system.

High pressure oil for the hub and blade assembly is supplied to the OD box by the CPP system hydraulics through a line (not shown) coupled to a fitting 78 on the aft component 12 of the housing and passes through a passage 80 in the aft component to a journal clearance seal 82 mounted within the aft component and loosely held against rotation by a pin 84. The seal 82 is in a sliding fit with the housing components 12 and 36, and the OD box shaft runs within the sealing faces of the seal 82, which floats on an oil film. Leakage aftward past the seal 82 is stopped by the lip seal assembly 20, and any over-pressure due to leakage is released through the unloading valve 34. Oil that leaks forward past the seal 82 is returned to the pump reservoir through the return passage 42.

Radial passages 85 through the OD box shaft 58 provide a path or high pressure oil to an annular supply chamber 86 defined by the inner walls of the shaft 58 and shaft extension 60 and the outer walls of the valve rod 68 and piston rod 72 and by an aft seal 88 carried by the seal mount 62 and a forward seal 90 carried by the cylinder member 64 of the OD box auxiliary servo. The annular chamber 86 allows the valve rod to move axially and receive oil through passages 92 throughout its operating stroke. The high pressure oil for operating the main pitch-control servo is conducted aft to the hub in the annulus between the valve rod 68 and the prairie air tube. In CPP systems without a prairie air system the high pressure oil supply to the main servo is simply through the valve rod.

Return oil from the main servo in the propeller hub passes through the annulus between the valve rod and the propeller shaft. Lengthwise passages 94 in the OD box shaft 58 conduct the return oil to the discharge passage 42, from which it is returned to the pump reservoir.

The piston 74 divides the annular chamber defined by the cylinder member 64, the cylinder head 66 and the piston rod 72 into two sections, each of variable working volume. The piston rod 72 is sealed by an aft seal 96 to the chamber 64 and a forward seal 98 to the cylinder head. Because the shaft and servo chamber unit rotates with the valve rod and piston unit of the OD box, the seals 96 and 98 can hold very high pressures, which, as described below, is essential for emergency take-home operation of the CPP system. The piston rod has a uniform outer diameter along its length and extends forwardly out through the cylinder head to prevent pressure surges when the valve rod and piston unit moves axially during a pitch change. The outwardly-protruding forward end portion of the piston rod 72 also provides pitch-position indication in the form of its axial position. A bearing assembly 100 on the forward end of the piston rod 72 provides the pitch-indication input for a pitch indicator and the CPP control system (not shown).

Figure 1B:
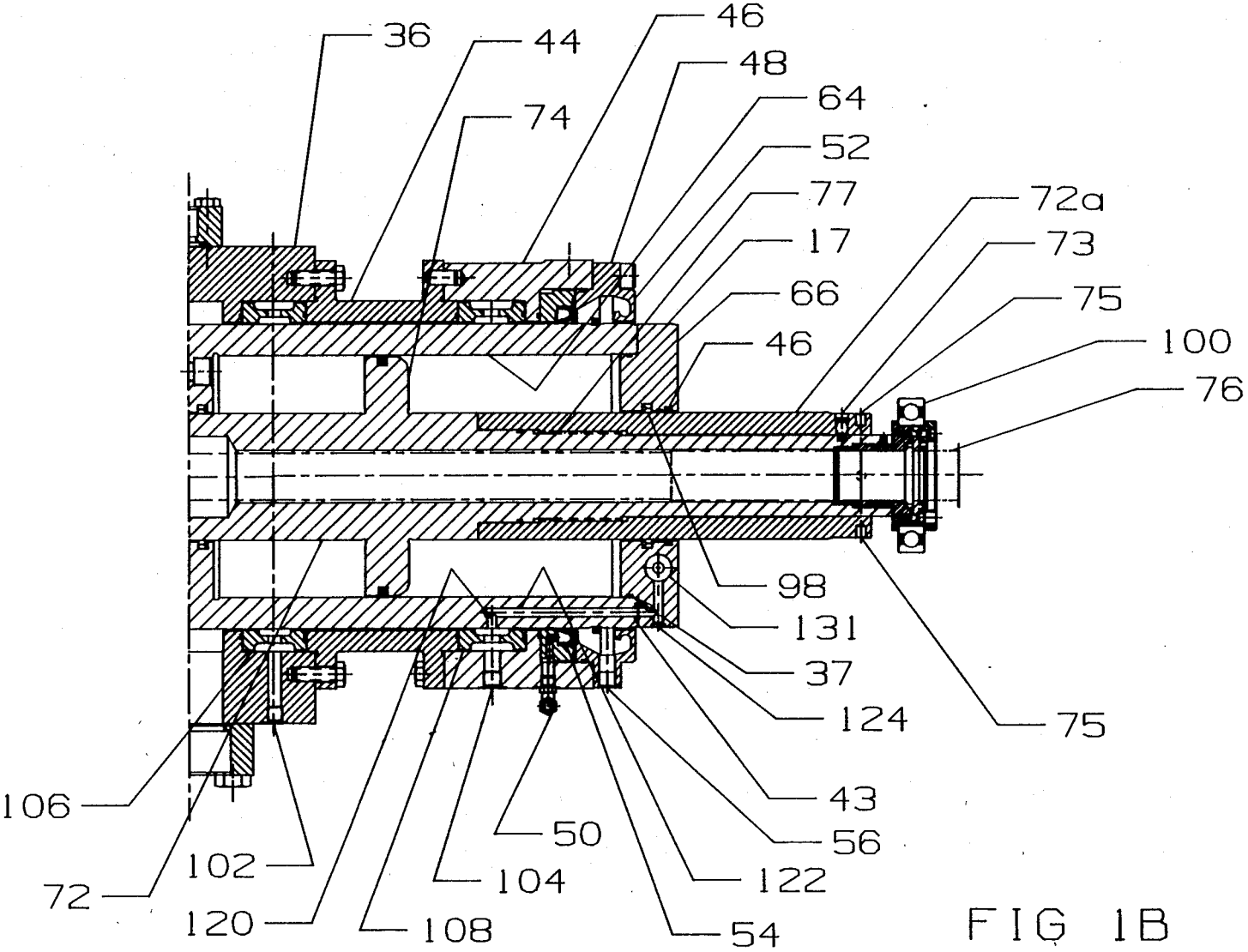
Figure 2:
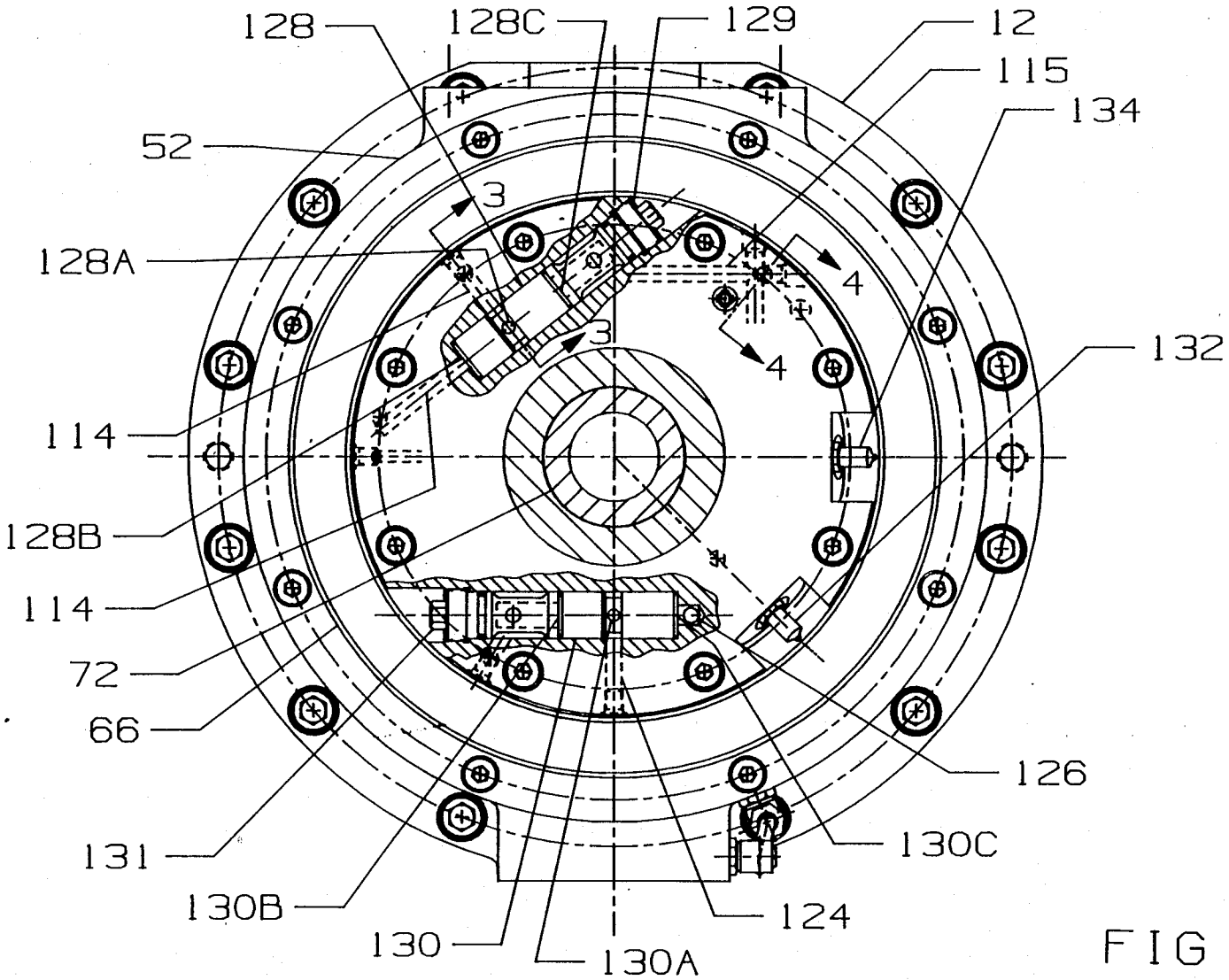
FIG. 2 is an elevational view of the foreward end of the embodiment.
Figure 4:
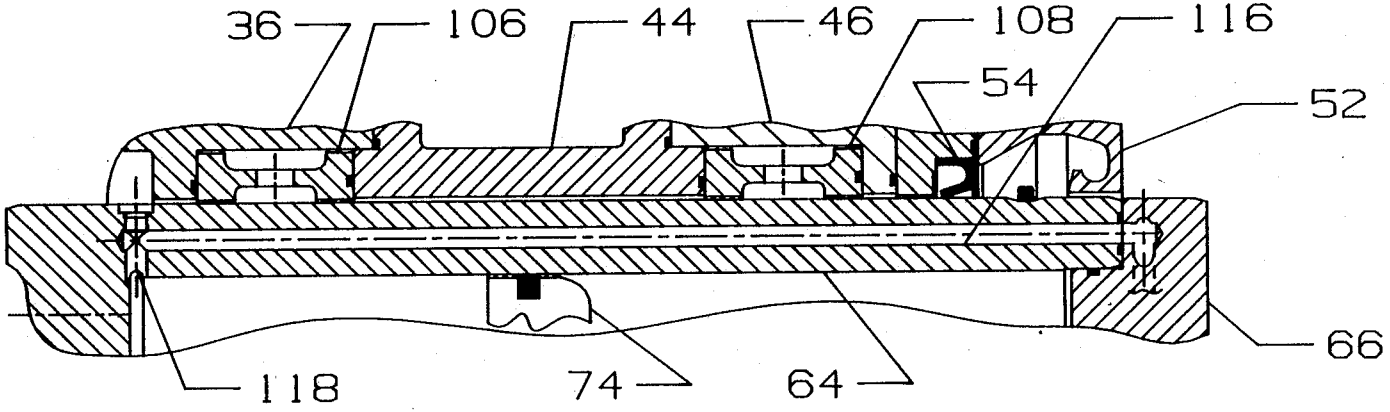
FIG. 4—4 is another fragmentary cross-sectional view of the servo cylinder wall and adjacent housing, in this case taken along the lines 4—4 of FIG. 2.
Figure 3:
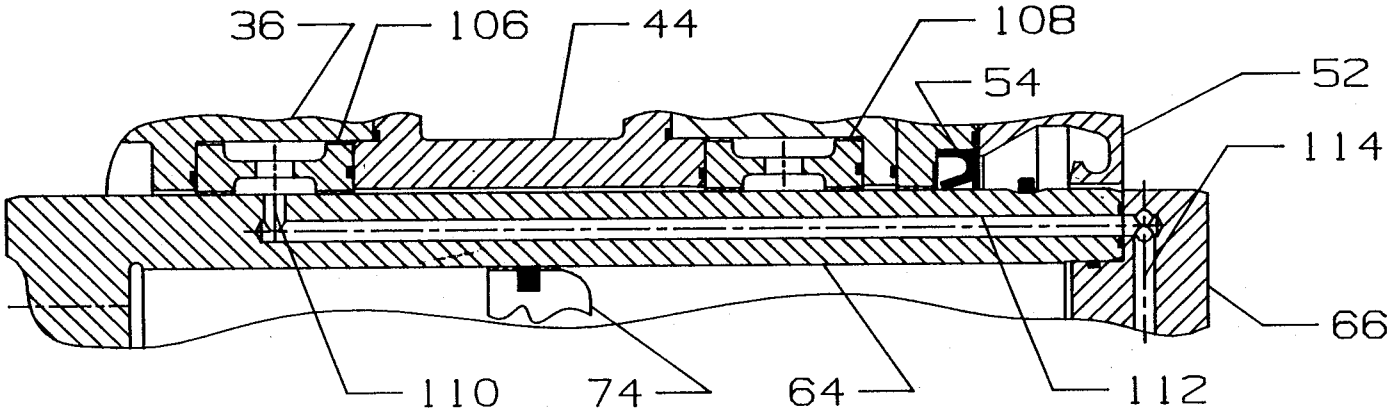
FIG. 3—3 is a fragmentary cross-sectional view of the wall of the auxiliary servo cylinder and adjacent housing, the view being taken along the lines 3—3 of FIG. 2.
Figure 6:
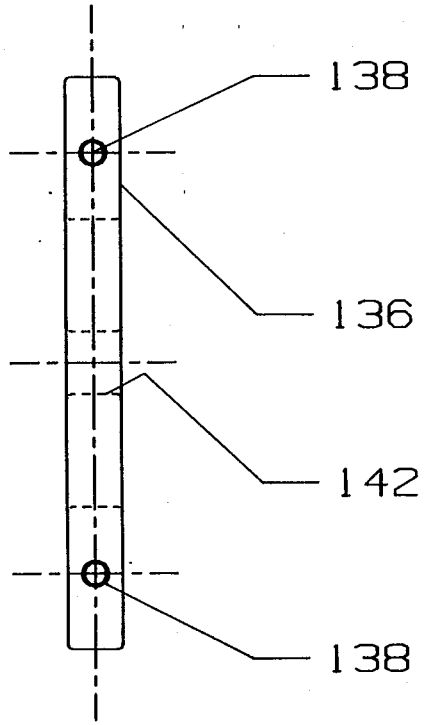
FIG. 6 is a side elevational view of the collar of FIG. 5.

The auxiliary servo of the OD box provides the normal operating control of the main servo in the hub by moving the valve rod 68 forward or aftward, which changes the position of the spool of the directional valve, thereby directing oil to either the astern or ahead side of the main servo cylinder. To move the valve rod, hydraulic fluid is supplied under pressure through a control valve (not shown) to the appropriate one of the passages 102 and 104 that lead to respective journal clearance seals 106 and 108 carried with a sliding fit by the casing members 44 and 46. Fluid supplied to the seal 106 flows to the aftward section of the servo cylinder through a series of passages bored (and plugged as required) in the cylinder member 64 and cylinder head 66, to wit: short radial passage 110 (FIG. 3); longitudinal passage 112 (FIG. 3); radial passage 114 and chordal passage 115 (both in the head, FIG. 2); longitudinal passage 116 (FIG. 4); and radial passage 118 (opens to chamber, FIG. 4). Fluid supplied to the seal 108 flows to the forward section of the cylinder through the following passages: short radial 120 (FIG. 1B); longitudinal 122 (FIG. 1B); radial 124 in head (FIG. 2); axial 126 in head (FIG. 2, opens to chamber). Of course fluid returns through these passage systems from the cylinder section toward which the piston 74 is moving during a pitch change.

A pilot-operated check valve 128, 130 is interposed in the passageway system between each of the journal clearance seals 106 and 108 and the corresponding section of the servo chamber served by the seal. Each valve 128, 130 is installed in a bore in the head and is held in place in the bore by a retainer 129, 131. The valves are of the cartridge type and are available commercially from several sources, such as Kepner Products Company of Villa Park, Illinois. Each valve has an inlet port 128A, 130A near the middle of the cartridge, a pilot port at one end 128B, 130B and an outlet port at the other end 128C, 130C. Each retainer 129, 131 has a passage and a port (see FIG. 2) associated with the adjacent valve port. The pilot port 128B of the valve 128 communicates through passages (only partly shown) in the head 66 and cylinder member 64 with the journal clearance seal 108. The pilot port 130B of the valve 130 communicates through passages (also only partly shown) with the seal 106.

Figure 7:
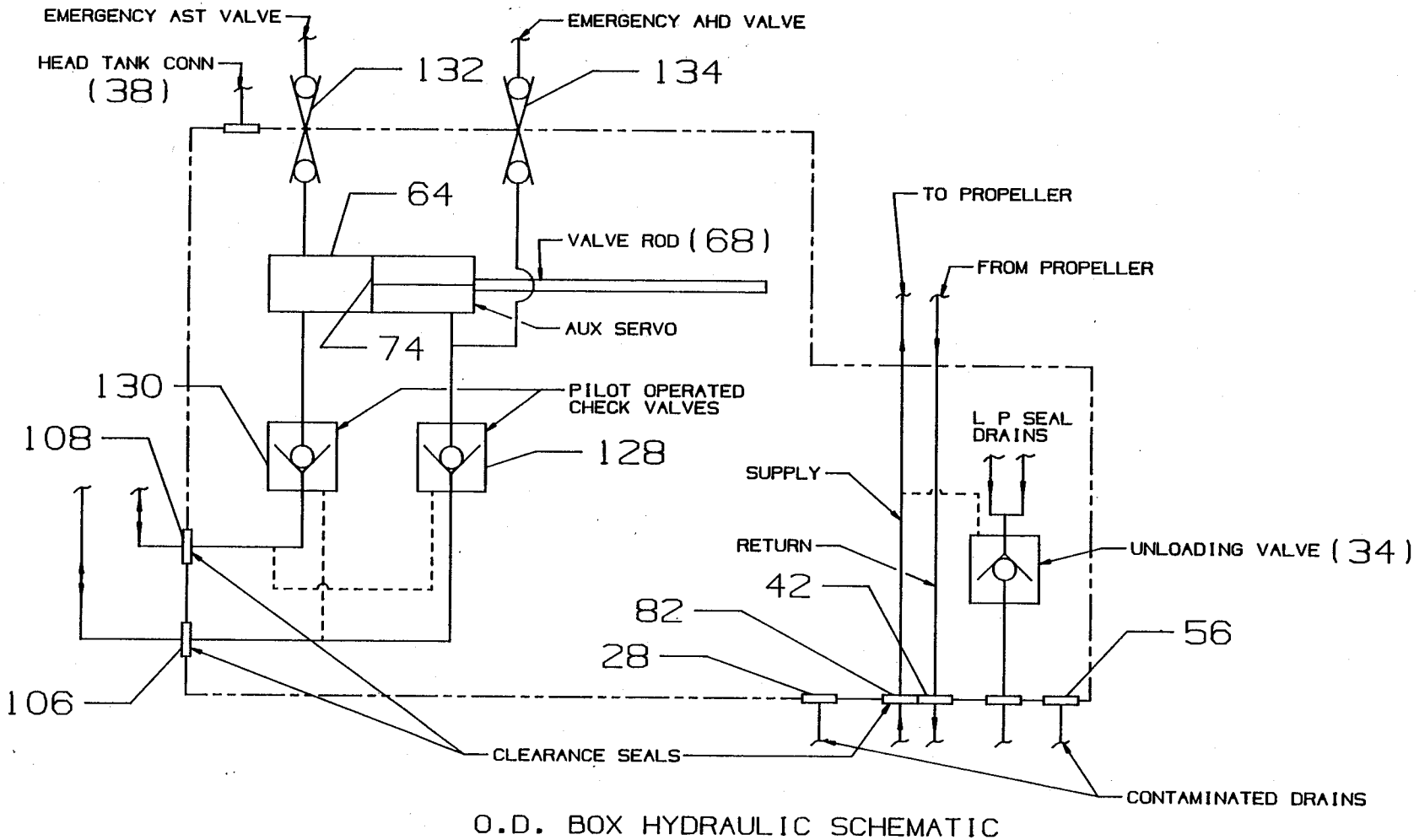
FIG. 7 is a schematic diagram of the hydraulic system of the embodiment.

As may best be understood by referring to FIG. 7, when the control valve of the auxiliary servo opens to supply fluid through one of the clearance seals 106, 108, the pressure at the inlet port of the check valve associated with that seal opens and allows fluid to pass and flow into the chamber section associated with that valve. The pressure of the fluid supplied through the seal is also applied to the pilot port of the other check valve, thereby opening the other check valve and allowing fluid in the other section of the servo cylinder chamber to be returned through the pilot-operated valve and the corresponding passage system to the other journal clearance seal and thence to the fluid source.

When the fluid flow from the CPP auxiliary servo control valve is cut off upon completion of a pitch change, both check valves 128, 130 close and isolate the servo-cylinder chamber from the journal clearance valves, thus locking the auxiliary servo hydraulically in the desired pitch-control setting.

Quick release valved hose couplings 132 and 134 are installed in the head 66 and communicate through passages (not shown, but see FIG. 7) in the cylinder member 64 and head 66 with the servo chamber sections. An emergency pump can be hooked up to the couplings 132, 134 to supply high pressure fluid to the OD box auxiliary servo to move the valve rod and provide mechanical pitch-adjusting and setting of the CPP for emergency take-home operation. The isolation of the OD box servo cylinder by the check valves 128, 130 from the journal clearance seals ensures that mechanical pitch-setting can be accomplished, inasmuch as the clearance seals are isolated and not involved in emergency take-home operation of the OD box. Without the check valves, leakage past the clearance seals would make it difficult, at best, to accomplish mechanical pitch-setting.

It is preferable, though not essential, that during emergency take-home operation of the CPP system propeller pitch be held at maximum ahead against mechanical stops in the hub and that the valve rod be loaded in tension to a level exceeding hydrodynamic loads on the propeller, thereby producing a pre-stress in the valve rod for superior resistance to alternating and varying loads on the propeller. Reaction loads of the tensioned valve rod and the piston of the OD box auxiliary servo are exerted on the chamber member 64 and thence on the propeller shaft, a desirable improvement over the prior systems, in which reaction loads acted on the OD box housing and ultimately on the gear box casing.

Although the emergency take-home mode of the OD box can be maintained hydraulically with the pitch at any value between full ahead and full astern, the preferred maximum ahead pitch position, with the valve rod pre-stressed, can be held mechanically. After the auxiliary servo is activated hydraulically by the emergency pump to establish the maximum pitch and to pre-stress the valve rod, a sleeve **72*a* threaded by threads 77 onto the forward end of the piston rod 72 and normally locked in place by a locking screw 73 is released by loosening the locking screw 73 and is partly unthreaded, using a spanner wrench applied to the wrench holes 75 on the forward end of the sleeve 72*a*, to open up a gap or groove between the aft end of the sleeve and the adjacent shoulder on the piston rod 72. With the auxiliary servo in the full ahead position—FIG. 1B shows the OD box at approximately zero pitch—the gap lies just forward of the cylinder head member 66**.

Figure 5:
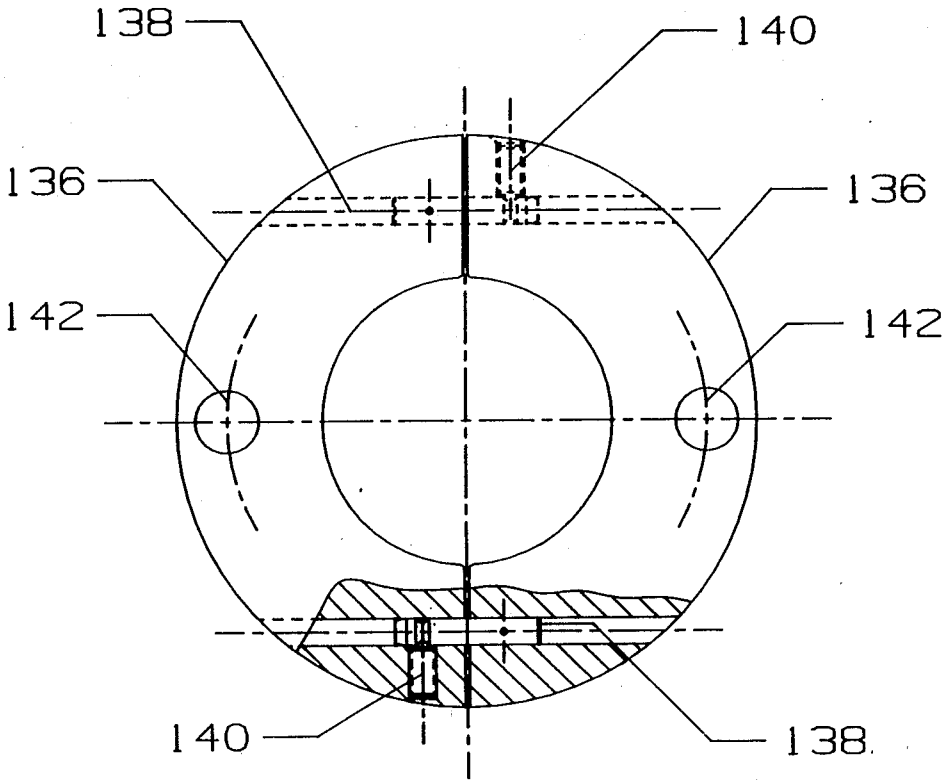
FIG. 5 is a front elevational view (partly broken away in cross-section) of a double C-shaped collar used to lock the valve rod mechanically in the full-ahead, emergency take-home position.

A locking collar, shown in FIGS. 5A and 5B, and comprising a pair of C-shaped members 136, is installed in the gap. Each collar member 136 has a protruding grooved pin 138, the groove of which accepts a spring-loaded ball detent device 140 that holds the members in mated relation to form a ring. A hole 142 in each member 136 facilitates removal of the collar. After the collar is snapped in place in the gap, the sleeve **72*a* is threaded aftward to engage the aft end with the collar. The pressure in the OD box auxiliary servo is then let down to enable the reaction load of the valve rod to be applied from the sleeve 72*a* to the collar members 136, which in turn transmits the reaction load to the head member 66, the cylinder member 64**, the gear box output shaft (not shown) and the propeller shaft (not shown). The emergency pump is then disconnected and propulsion power restored to the ship's drive.

The mechanical take-home mode is deactivated by stopping the ship's drive, pressurizing the auxiliary servo with the emergency pump to unload the collar, removing the collar and restoring the sleeve **72*a*** to the locked position. Operation in either the hydraulic take-home mode at a desired pitch position or normal hydraulic operating mode can be resumed.

We claim:

1. An oil distribution box for a marine controllable pitch propeller of the type having a main hydraulic servo within a hub for controlling the pitch of propeller blades rotatably carried by the hub and including a directional valve actuated by linear motion of a tubular valve rod extending through the propeller shaft from the oil distribution box, comprising an outer stationary housing; a shaft received within the housing and adapted to be coupled to the propeller shaft for rotation therewith; an auxiliary servo in the housing including a cylinder coupled to the shaft and defining a servo chamber and a piston received for axial movement in the servo chamber, coupled to the valve rod and dividing the chamber into sections on its opposite sides; means for supplying high pressure oil from a source to the valve rod for conduction by the valve rod to the main hydraulic servo and including an elongated annular supply chamber defined between the shaft and the valve rod by spaced-apart seals, a port in the valve rod opening to the supply chamber, a port in the shaft opening to the supply chamber and a journal clearance sea between the housing and shaft in register with the port in the shaft; and means for supplying oil under pressure from a source selectively to either section of the servo chamber and returning oil to the source from the other section including for each section a supply-return passageway in the cylinder communicating with the respective section, a passage in the housing, a journal clearance seal between the housing and the cylinder in register with the passage and the passageway and a normally closed pilot-operated check valve in the suppy-return passageway adapted to open in response to the supply of oil under pressure to either of the passageways such that oil is supplied to the selected section and returned from the other section.

2. An oil distribution box according to claim 1 and further comprising means for supplying oil under pressure selectively to each section of the servo chamber, from an emergency source and returning oil to the emergency source from the other section to provide a pitch-setting for emergency take-home operation.

3. An oil distribution box according to claim 1 wherein each check valve is built into a cylinder head member of the servo chamber.

4. An oil distribution box according to claim 1 wherein the servo chamber includes a head member at its forward end and the servo piston is carried by a piston rod that is coupled to the valve rod and includes a portion projecting forwardly through the head member in sealed relation, whereby its axial position provides an indication of the propeller pitch.

5. An oil distribution box according to claim 4 wherein the servo piston rod extends entirely through the servo chamber in all positions of its working stroke and is of uniform diameter so as to provide equal and opposite changes in displacement in the sections of the servo chamber on opposite sides of the piston upon movement of the piston.

6. An oil distribution box according to claim 5 and further comprising a sleeve on the forward end of the servo piston rod adapted to be fixed to the piston rod and to form a gap therewith adjacent the external face of the head member, and a collar receivable in the gap in load-bearing engagement with the head member to hold mechanically a forward pitch-setting for take-home operation of the propeller.

7. An oil distribution box according to claim 6 wherein the sleeve is threaded onto a reduced diameter portion of the piston rod.

* * * * *